US005353730A

United States Patent [19]

Talbot

[11] Patent Number: 5,353,730

[45] Date of Patent: Oct. 11, 1994

[54] MULTI-USE WATERCRAFT

[76] Inventor: Dennis W. Talbot, 5220 S. 935 East, Salt Lake City, Utah 84117

[21] Appl. No.: 97,080

[22] Filed: Jul. 22, 1993

[51] Int. Cl.[5] ..... B63B 7/04

[52] U.S. Cl. ..... 114/248; 114/39.1; 114/77 R

[58] Field of Search ..... 114/248, 270, 39.1, 114/246, 77 R, 352, 138, 290

[56] References Cited

U.S. PATENT DOCUMENTS

| | | | |
|---|---|---|---|
| 2,989,939 | 6/1961 | Tatter | 114/290 X |
| 3,238,911 | 3/1966 | Pazulski | 114/39.1 |
| 3,291,088 | 12/1966 | Klose | 114/39.1 |
| 3,347,201 | 10/1967 | Szabo | 114/248 |
| 3,659,546 | 5/1972 | Miklos | 114/248 X |
| 3,815,541 | 6/1974 | Hansen | 114/248 |
| 5,167,550 | 12/1992 | Nielsen | 440/84 |
| 5,255,625 | 10/1993 | Hattori | 114/248 |

*Primary Examiner*—Sherman Basinger
*Attorney, Agent, or Firm*—Workman, Nydegger & Jensen

[57] ABSTRACT

A multi-use watercraft wherein a bay, or bays, is formed in the aft portion for docking a personal watercraft (PWC). The PWC are connected to provide propulsion for the multi-use watercraft when so docked in the bay. The multi-use watercraft and the PWC may be separated and used independently while on the water. The PWC may also be docked in the bay of the multi-use watercraft while on the water. Also provided is the ability to sail the multi-use watercraft. Mast, rudders and dagger board may be installed while on the water thus allowing the multi-use watercraft to use wind for propulsion. The multi-use watercraft may be converted to sailing mode with or without the PWC being docked.

21 Claims, 6 Drawing Sheets

MULTI-USE WATERCRAFT

BACKGROUND

1. Field of the Invention

The present invention relates to multi-use watercraft and personal watercraft. More particularly, the present invention is directed to utilizing personal watercraft for propulsion of a multi-use watercraft thereby eliminating the need for a self propelled multi-use watercraft.

2. Background Art

Water vessels of various types are well known in the art. Although some commercial water vessels, such as barges, rely on other water vessels for propulsion, few if any recreational watercraft do so. Recreational watercraft vary widely, including sail boats, power boats, house boats, fishing boats, and the like. Each of these is typically designed for a single main purpose, such as sailing or power boating, and provides it's own propulsion designed to advance that purpose.

Recently, a new type of recreational watercraft is enjoying increasing popularity. This is the personal watercraft (PWC). Watercraft of this variety are typically inboard Class A boats powered by 2-cycle, 2-cylinder engines, typically at or less than 1000 ccm engine replacement, and are propelled and steered by a jet pump or water jet propulsion via an impeller. Trademarks under which these types of watercraft are marketed include Tigershark, Sea-Doo, Jet Ski, and Wave Runner, although newer makes and models are frequently introduced. Manufacturers of these PWC associate typically through the Personal Watercraft Industry Association (P.W.I.A.).

PWC of the aforementioned variety accommodate riders in motorcycle-style front and back seating positions, although some makes and models allow side-by-side rider seating. The driver or operator of the PWC steers the watercraft with motorcycle-style handlebars while sitting or standing. As many as two passengers are accommodated to ride with the driver. PWC are highly maneuverable and relatively easy to operate. Recreational uses vary from competitive buoy circuit racing to leisure cruising.

While both enjoyable to operate and easy to use, there are certain drawbacks to PWC. Typically, PWC are designed to carry a driver only, although some can carry up to two passengers, making them less enjoyable when taking out a group due to inherent cramped rider seating constraints. Most PWC have low power output, have difficulty towing a water skier, and are limited as to their transportational ability due to limited cargo storage area. By way of example, PWC riders and their cargo must inherently get wet during operation. This further limits the usefulness of the PWC to warm temperature operation and seasonal use. Waterproof cargo storage areas must be provided in the PWC to keep the cargo dry. The PWC riders must stow dry street clothing to change into when their use of the PWC is for transportation, rather than recreational use.

These drawbacks have necessitated the acquisition of both a PWC and a power boat to satisfy the aforementioned multiple utilitarian and recreational needs. For instance, a power boat can carry a number of passengers, transport dry cargo, and allow water skiing, while PWC are utilized for their somewhat limited type of water recreation.

The need to purchase both a power boat and PWC also has disadvantages such as the requirement of a separate means of transportation for each of the power boat and the PWC. Further, purchasing both a power boat and PWC is expensive.

BRIEF SUMMARY AND OBJECTS OF THE INVENTION

One object of the present invention is to provide a multi-use, multi-passenger watercraft which incorporates features and utilities of power boats with one or more PWC, and which may also incorporate features and utilities of a recreational sail boat.

Another object of the present invention is to provide a watercraft that satisfies the dual purposes of utilitarian watercraft transportation as well as personal and group watercraft recreation, while eliminating the need for acquiring both a self-propelled, cargo transporting watercraft and one or more PWC.

A further object of the present invention is to provide a multi-use watercraft which has ample power to pull a waterskier while carrying both cargo and passengers.

Another objective of the present invention is to provide an non-powered watercraft, with an interface system adaptable to a variety of PWC make and models, to enable a PWC to be used to power and direct the non-powered watercraft via the interface system.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

Briefly summarized, the above object and advantages are realized in a non-powered multi-use watercraft which incorporates one or more bays formed in the aft portion thereof for receivably accepting or docking PWC equal to the number of bays. When the PWC are docked in the bays, control is transferred from the PWC to the multi use watercraft via an interface system. The PWC are then used to provide propulsion and direction for the non-powered multi-use watercraft.

The bays are constructed so that they will allow for docking of various makes and models of PWC via adapters. Adapters may be used to conform to the front hull configuration of the PWC being used to the bay configuration. Preferably, the adapter is designed of a lightweight material which can easily be lifted in and out of the bay, respectively, for installation therein and removal therefrom. Alternatively, adapters can be prefit on to the front hull configuration of the PWC prior to docking into the bay.

Each bay will preferably have a bottom portion which extends from the aft of the multi-use watercraft approximately half the length of the bay and which conforms the bottom configuration of the PWC to the bottom configuration of the multi-use watercraft. This bottom portion betters the fluid dynamic efficiency between the two integrated watercraft by eliminating the formation of partial vacuums in the flowing water as a result of the separation of the water into parts, also known as cavitation. The bottom portion and the adapter may be part of the same unit.

Linkages, used to transfer control from the PWC to the multi-use watercraft, include a stiff member for connecting to the throttle grip of the PWC so that the handlebars thereof may be pushed or pulled in the desired direction for steering the multi-use watercraft.

The stiff member is preferably made of a stiff but lightweight material such as aluminum. When the handlebars of the PWC are pushed or pulled, the jet propulsion port of the PWC is turned which causes the force exerted by water propelled therefrom to turn the multi-use watercraft in the desired direction.

In addition to the steering control, electrical control is also transferred to the multi-use watercraft via another linkage. The other linkage includes electrical controls for starting and stopping the engine, and a throttle cable. Electric controls are transferred through an electrical harness. The electrical harness must be enclosed in a watertight jacket to avoid electric shock, grounding, and premature weathering.

The multi-use watercraft may also include provisions for allowing sail power. A mast may be receivably mounted on the fore portion of the multi-use watercraft. Rudders may be connectably mounted to the aft portion of the multi-use watercraft. A dagger board may be receivably mounted in a slot provided in the middle portion of the multi-use watercraft between the starboard and port sides. The mast is stabilized using cables which may be connectably mounted fore, aft, port, and starboard on the multi-use watercraft. So rigged, sails may be hoisted on the mast to use wind power for propulsion of the multi-use watercraft. An optional jib may be conventionally rigged as well.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Understanding that these drawings depict only typical embodiments of the invention and are therefore not to be considered limiting of its scope, the invention in its presently understood best mode for making and using the same will be described with additional specificity and detail through the use of the accompanying drawings in which.

DETAILED DESCRIPTION OF THE PREFERRED EMBODIMENTS

Generally described, the present invention is a water going vessel having a boat means for carrying cargo and a personal watercraft means for powering the water going vessel. By way of illustration of a preferred embodiment of the inventive boat means, FIGS. 1 and 2, respectively, each show a multi-use watercraft, generally indicated at 10 and 110. One example of the personal watercraft means used for powering the water-going vessel is seen in FIGS. 3 and 4, generally indicated as a PWC 100.

The personal watercraft means has a means for intaking a stream of water, and has a means, aft of the water intaking means, for outputting the stream of water that was taken in at the intaking means. A jet pump means is used by the personal watercraft means for pumping the stream of water from the intake means to the outputting means so as to impel the personal watercraft means while floating in the water medium. A power plant means is used for driving the jet pump means.

Figure 3:
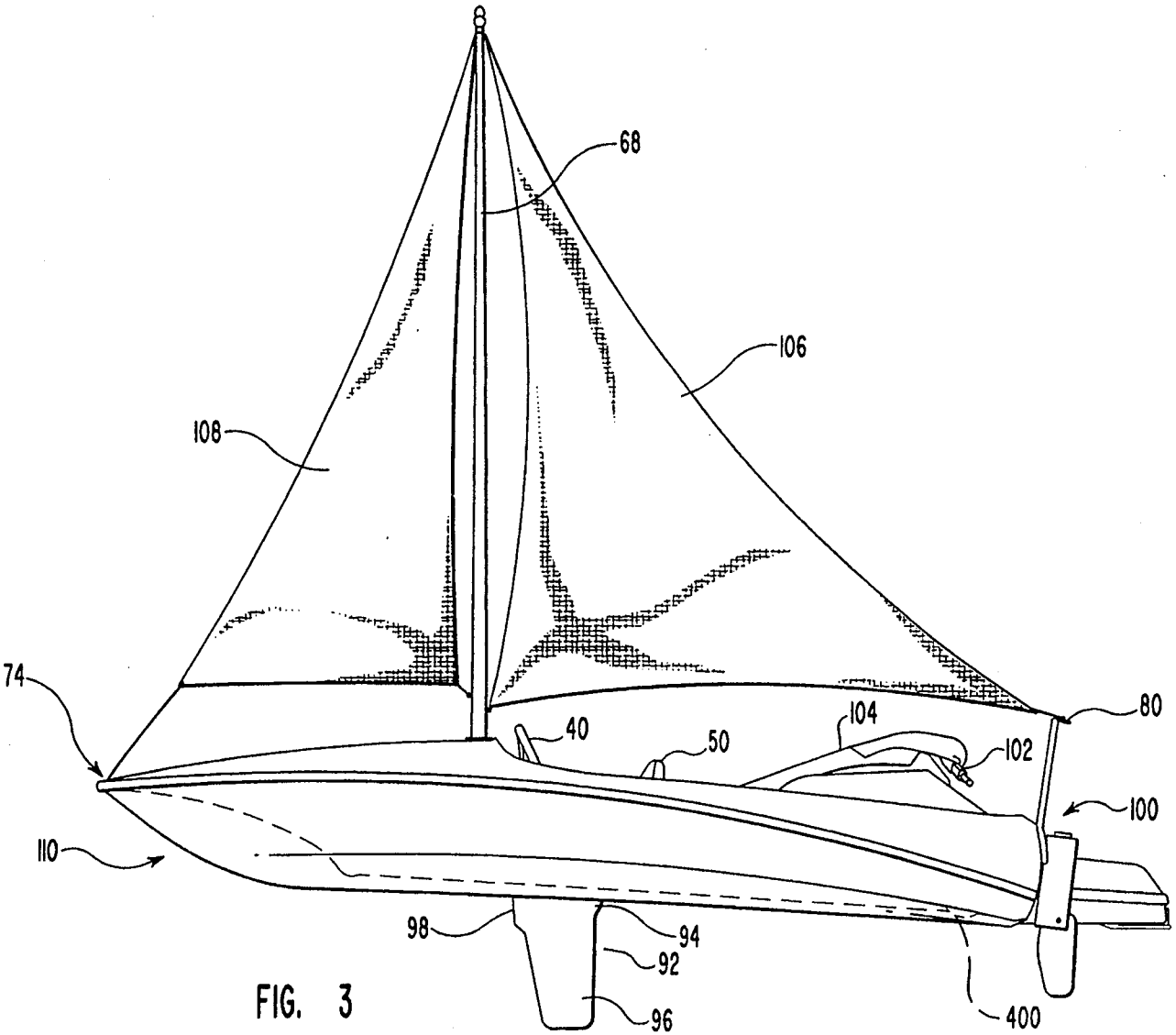
FIG. 3 is a side elevation view showing riggings for the sailing mode of the multi-use watercraft with a PWC docked in the bay thereof.
Figure 4:
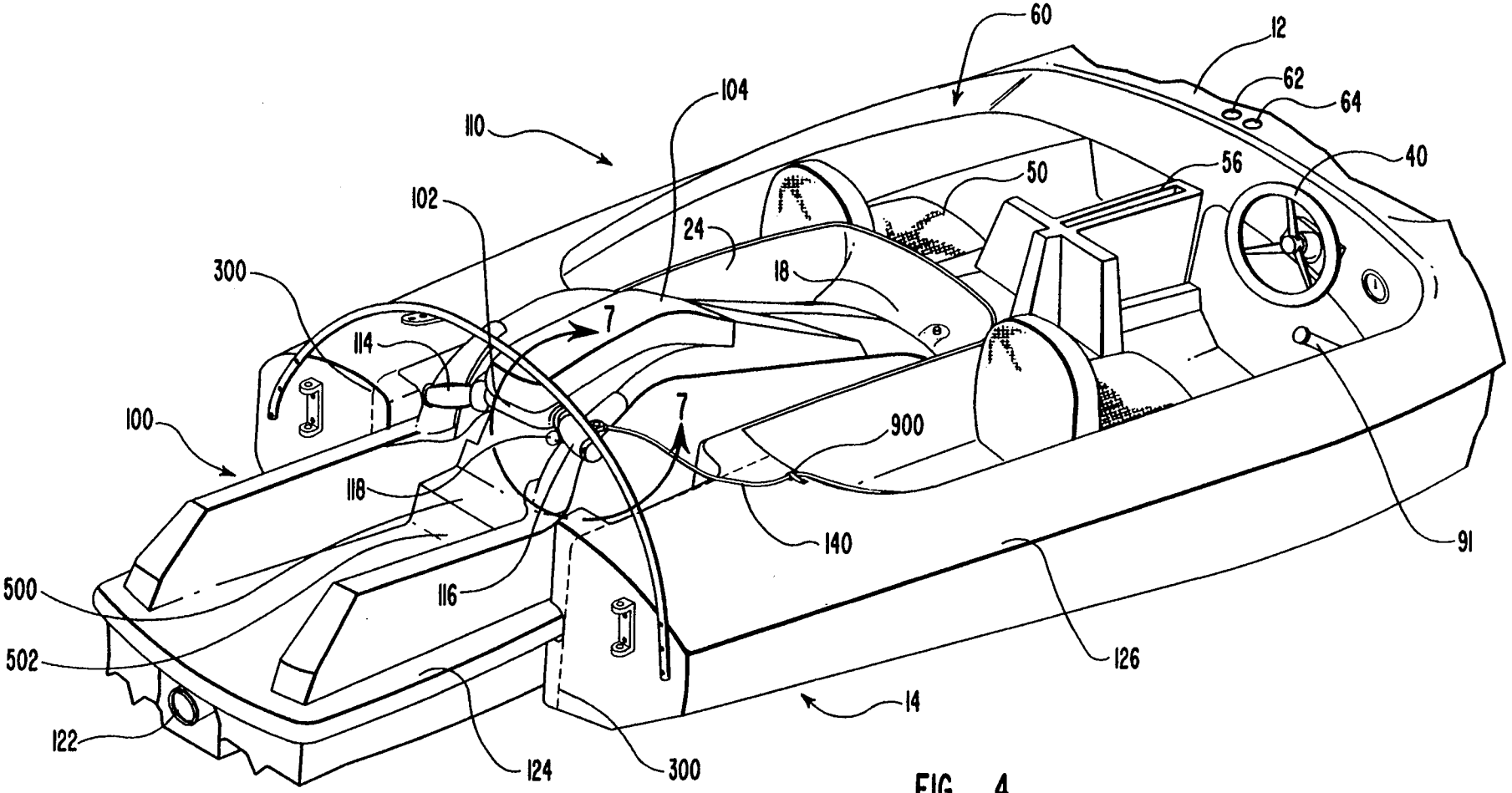
FIG. 4 is a perspective view of the aft portion of a single bay multi-use watercraft showing a PWC docked in the bay thereof.

By way of example and illustration of personal watercraft means components, and as seen in FIGS. 3 and 4, there is depicted an intake port 400 as the means for intaking the stream of water. An output port 122 is shown as the means, aft of the water intaking means, for outputting the stream of water that was taken in at the intaking means. Within the external body of PWC 100 is the cooperating and combined devices of a jet pump 502 as the jet pump means used by the personal watercraft means for pumping the stream of water from the intake means to the outputting means so as to impel the personal watercraft means while floating in the water medium, and an engine 500 as an example of the power plant means used for driving the jet pump means.

A handlebar means is used for controlling the angle of the outputting means with respect to both the port and starboard of said personal watercraft means so as to control the impelled direction of the personal watercraft means. Also, a means for controlling the jet pump means is part of the personal watercraft means so as to vary the flow rate of the water stream exiting the outputting means to control the propulsion rate of the personal watercraft means in the water medium. As shown in FIGS. 3, 4, 6 and 7 for the purpose of providing examples and illustrations, a handlebar means is shown as handlebars 102. The output port or jet propulsion port 122 is controlled by handlebars 102 of PWC 100. The direction of jet propulsion port 122 is changed by changing the orientation of handlebars 102 so as to turn PWC 100.

PWC 100 has a forward portion 110 and an aft portion 112. Forward portion 110 has a yoke 104 mounted thereon. Handlebars 102 are part of yoke 104. The handlebars 102 include port grip 114 and starboard grip 116. As an example of the means for controlling the jet pump means, a thumb throttle 118 is mounted on starboard grip 116 of handlebars 102. Thumb throttle 118 may be linked to the throttle lever 91 by control cabling 120.

Some PWC have a mechanism which urges yoke 104 upward so that it requires less energy for the user to hold yoke 104 up while steering PWC 100. If such a PWC is being used as the propulsion unit of the multi-use watercraft, it may be desirable to attach a strap over yoke 104 of PWC 100 to hold it in a down position. Such a strap could be attached to the boat means or on PWC 100 itself. This strap would keep yoke 104 from bouncing around during use of the multi-use water craft. However, it is not necessary to proper operation of the multi-use water craft.

Figure 1:
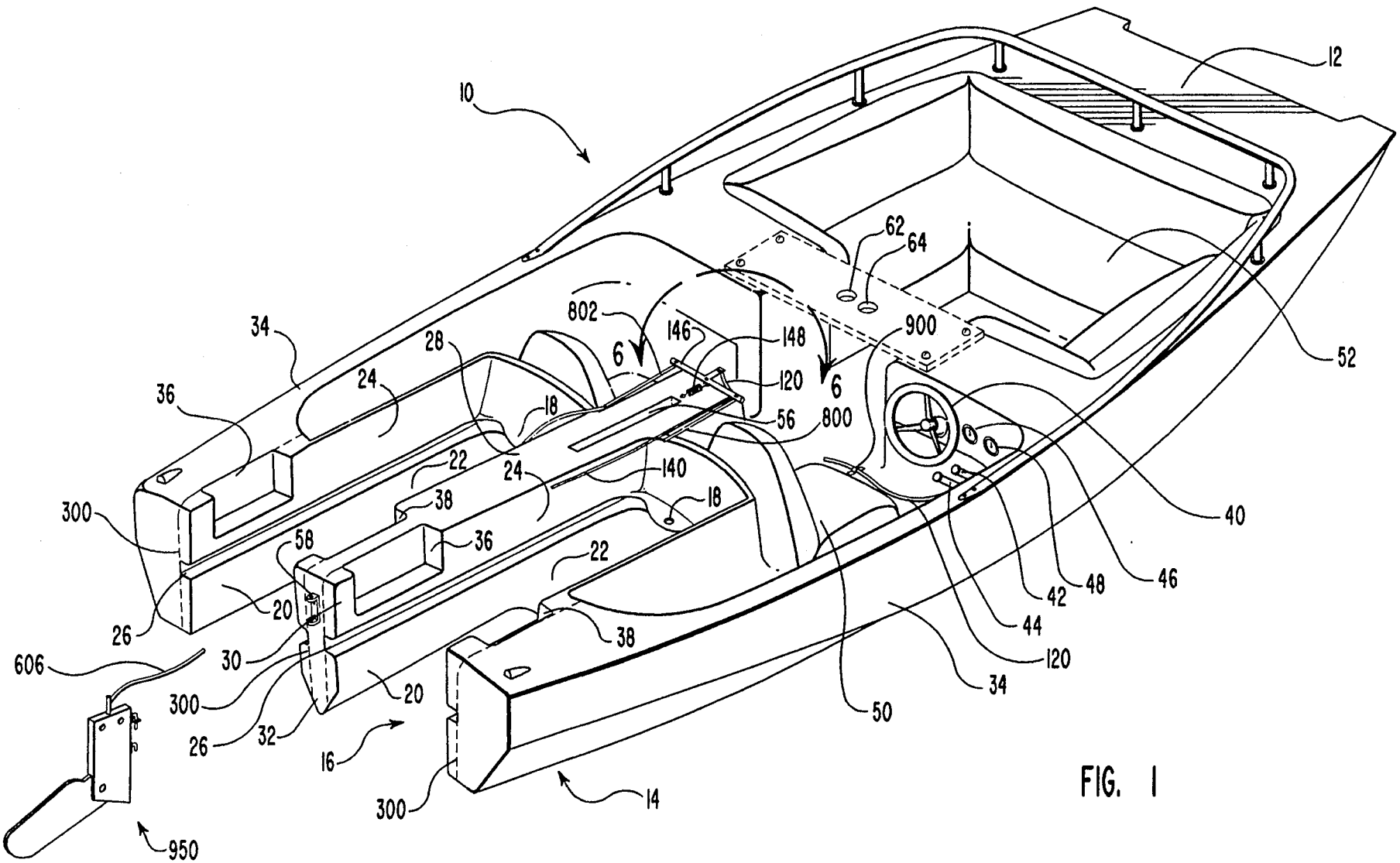
FIG. 1 is a perspective view showing a dual bay multi-use watercraft.
Figure 2:
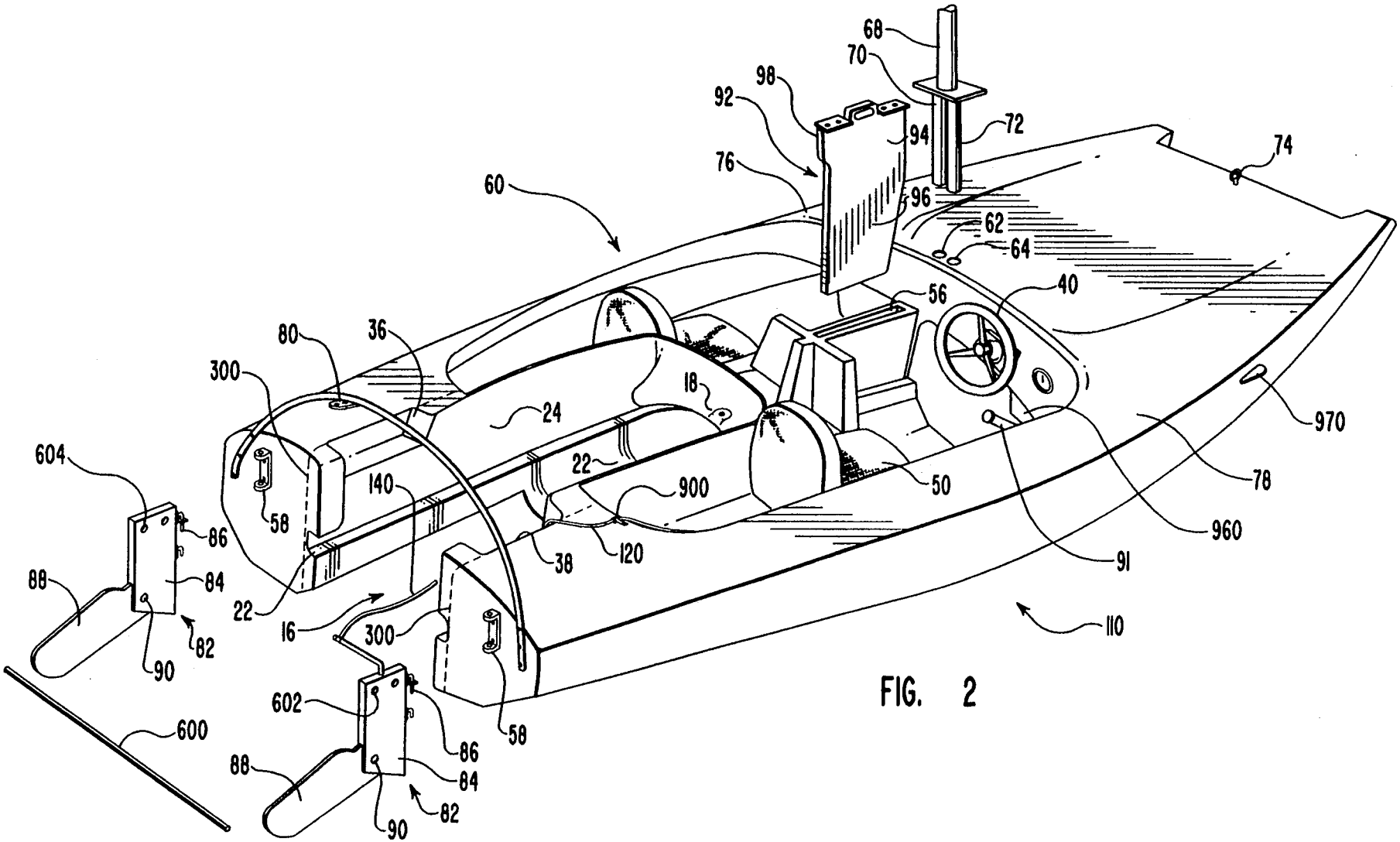
FIG. 2 is a perspective view showing an alternative embodiment of the multi-use watercraft having a single bay.

The boat means has a top side with a cargo area which carries cargo of passengers, packages, and the like, and also includes a docking means for slidably receiving and at least in part circumscribes a portion of the hull configuration of the personal watercraft means. The docking means includes a means for maintaining the intake means of the personal watercraft means in the water medium while the water vessel is underway and also includes a releasable attachment means for holding the hull configuration of the personal watercraft means within said docking means. FIGS. 1 and 2 show respective examples of the docking means by two and one bay 16 embodiments, with FIG. 1 accommodating two PWC (not shown) and FIG. 2 accommodating one PWC (not shown) via bays 16. FIGS. 3 and 4 show by example how bay 16 slidably receives and at least in part circumscribes a portion of the hull configuration of the personal watercraft means, in which an example of the personal watercraft means is generally indicated by PWC 100.

Multi-use watercraft 10, 110 have a bow or forward portion 12 and a stern or aft portion 14. Aft portion 14 of multi-use watercraft 10, 110 have bays 16 formed therein for receivably accepting, or docking, PWC 100 as seen in FIG. 4. Bays 16 have a forward portion 18 and a rear portion 20. Forward portion 18 is curved, and is in effect a recessed area, to allow for at least in part circumscribing a portion of the hull configuration of PWC 100 and to allow for better conformance between the surface of each bay 16 and the hull of PWC 100. The cargo area is generally indicated at 60.

As mentioned, the boat means has a means for maintaining the intake means of the personal watercraft means in the water medium while the water vessel is underway. As an example of the means for maintaining the intake means in the water medium, FIGS. 2 and 3 illustrate that at the bottom of forward portion 18 of bay 16, there is a plate 22 for conforming the bottom of PWC 100 to the bottom of multi-use watercraft 110. Such a plate may also be incorporated in the two bay embodiment of FIG. 1. This helps to ensure proper fluid dynamics of multi-use watercraft 10, 110 with respect to PWC 100 when PWC 100 is docked in bay 16. Plate 22 extends approximately half the length of bay 16. Plate 22 functions to set the attitude of PWC 100 such that intake port 400 is essentially under water at all probable vessel knots and sea conditions when PWC 100 is docked in bay 100. When intake port 400 is kept under water, jet pump 500 is provided with a constant stream of water to the jet pump due to plate 22, rather than a stream of water which is interrupted by vacuum or air pocket intake. The constant supply of water to jet pump 500 prevents cavitation and ensures smoother operation. Preferably, the configuration of plate 22 has tolerances with respect to the hull of PWC 100 such that PWC 100 can be easily ridden into place in bay 16 while vessel 10, 110 is either underway or is dead in the water. Plate 22 has a trailing edge extending from one side to the other of the docking means. The docking means has a forward portion therein. When the hull configuration of the personal watercraft is received within the docking means such that the bow of the personal watercraft is in contact with the forward portion of the docking means, the plate is in contact with and supports a portion of the keel configuration of the personal watercraft and the trailing edge is located forward of said intake port of the personal watercraft.

Figure 5:
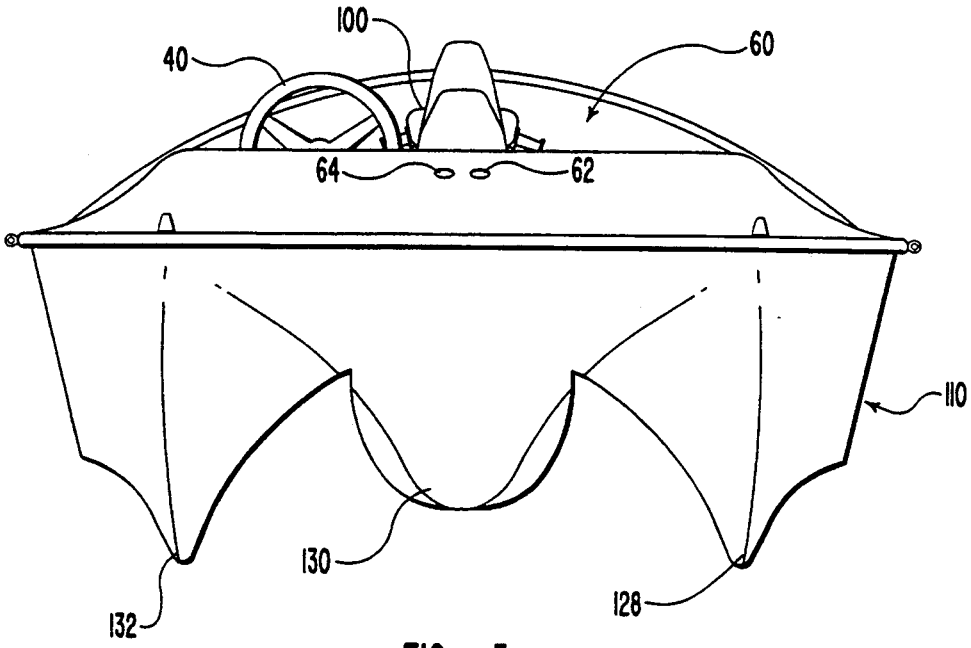
FIG. 5 is a front view showing an example of a hull configuration of a single bay multi-use watercraft.

FIG. 5 illustrates the presently preferred design of hull 126 of the single bay multi-use watercraft 110. A three hull design is utilized including a port hull 128, a mid hull 130, and a starboard hull 132. The mid hull 130 is formed as part of plate 22 and betters the fluid dynamic efficiency between the two integrated watercraft by eliminating vacuums or air pockets in the flowing water as a result of the separation of the water into parts, also known as cavitation. This design allows for conformance between the bottom of multi-use watercraft 10, 110 and the bottom of PWC 100. It will be appreciated that other hull designs may be utilized, the preferred feature being the interfaced ability to conform the bottom of each of the watercraft to achieve proper hydro dynamics by incorporating into the boat means a means for maintaining the intake means of the personal watercraft means in the water medium while the water vessel is underway.

Other examples of a means for maintaining the intake means of the personal watercraft means in the water medium while the water vessel is underway are contemplated, such as the inclusion of clamps or locks at stern 14 of vessels 10, 110 so as to maintain the attitude of the personal watercraft means with intake port 400 submerged at all probable knots and sea conditions. Such other embodiments, so designed to minimize cavitation of the waterstream entering the intake means of the personal watercraft means, are within the contemplation of the present invention and are thus considered equivalents.

Each bay 16 has walls 24. Walls 24 of forward portion 18 are curved to receive the hull of PWC 100. Walls 24 may also have a groove 26 formed therein for receiving a bumper which may be located on the circumference of PWC 100. Groove 26 is illustrated approximately halfway up wall 24 of bay 16. It will be appreciated that both groove 26 and front portion 18 may vary in size or position between makes and models of PWC. FIG. 4 depicts the bumper 124 of PWC 100 as received in groove 26 formed in wall 24 of bay 16. As previously noted groove 26 may be re-positioned, enlarged, or eliminated depending on the desired fit.

Since the size and shape of the hull of the personal watercraft means differ between both makes and models, the stern of the personal watercraft means can have a recessed area in the stern and an adapter means, situated on an external surface of the recessed area, for cushioning and making an interface of conforming fit between the hull configuration of the personal watercraft means and the recessed area. Thus, vessels 110 and 10 can accommodate various makes and models of personal watercraft and vessel 10 could accommodate two different makes and models of personal watercraft means via properly sized adapter means. By way of illustration of the adapter means, FIGS. 1, 2, and 4 show foam pads 300 which can be used to conform and mate PWC 100 to bay 16. Alternatively, foam pads 300 could also be replaced by layered shim strips sculpted within bay 16 and generally layered on top of front portion 18, walls 24 and plate 22 to conformingly fit the hull configuration of PWC 100 so as to accomplish the same function.

The adapter means may also be one or more pieces of material set in the recessed area or bay to accomplish a similar function. Alternatively, the adapter means may be eliminated by designing bay 16 to fit the particular make and model of a desired PWC. Of course, adapter means need not accommodate groove 26 if the PWC being utilized does not have a bumper. Other methods and means accomplishing functionally similar adaptations are considered equivalents.

Although the dual bay embodiment of the present invention can accept two personal watercraft, an example of which is illustrated and has been described with respect to FIG. 1, it is not necessary to utilize both personal watercraft for propulsion. If required, a single personal watercraft can provide adequate propulsion for the dual bay embodiment. However, it is preferable to use both personal watercraft for propulsion in the dual bay embodiment.

As shown in the dual bay embodiment of vessel 10 in FIG. 1, center portion 28 serves to separate bays 16. Center portion 28 has a top portion 30 and a bottom portion 32. Bottom portion 32 is designed to conform to the overall height of the stern, general designated by 34.

A releasably attachable means is used to lock the PWC to the docking means, an example of which is a hole and spike combination 18 which hooks through a hole (not shown) on the bow of the PWC 100 (see FIG. 4) to as to retain the bow therein. Other means of retaining the PWC in the docking means are contemplated, and those performing like functions as such are deemed equivalents.

Figure 7:
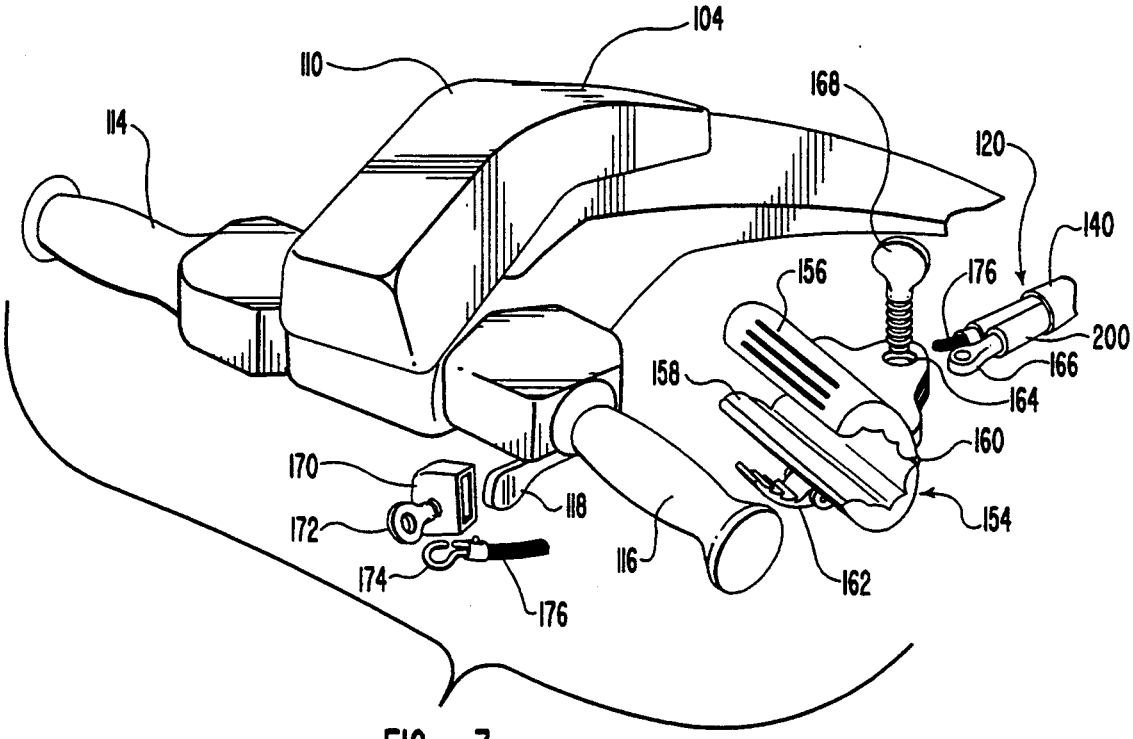
FIG. 7 is an exploded, disassembled view of the handlebars and connections to a thumb throttle configuration and steering grip of the PWC.

Port side cavities 36 and starboard cavities 38 in bays 16 may be formed, if necessary, to allow for free and extended movement of handle bars 102 of PWC 100 (see also, 114, 116 in FIG. 7).

The boat means has a steering means for a user to control the impelled direction of the boat means in the water medium. The steering means includes a user steering interface and a steering linkage means, connected to the handlebar means of the personal watercraft means and also connected to the user steering interface, for moving the handlebar means so as to control the angle of the outputting means.

The boat means also includes a throttle means for a user to control the jet pump means, the throttle means including a user throttle interface and a throttle linkage means, connected to the means for controlling the jet pump means and also connected to the user throttle interface, for moving the means for controlling jet pump means via the user throttle interface. By way of example and illustration of such means, FIG. 1 shows a throttle lever 42, as the user throttle interface, which controls the port side PWC while the similar throttle lever 44 controls the starboard side PWC. Throttle levers 42 and 44 are linked to the thumb throttles (see generally 118 in FIG. 7, described hereinafter) of PWC 100. FIG. 2 shows a throttle level 91.

An example of the steering means is seen in FIGS. 1, 2, 6 and 7 in which a user steering interface such as steering wheel 40 of the multi-use watercraft 10, 110 is connected by linking to the handlebars (114, 116 in FIG. 7) of PWC 100. Steering wheel 40 of multi-use watercraft 10, 110 is connected to an example of the steering linkage means as is illustrated particularly in FIGS. 1, 6, and 7 for the dual bay embodiment and in FIGS. 4 and 7 for the single bay embodiment. FIGS. 1, 4, 6, and 7 further depict examples, given herein for the purpose of illustration, of both the aforementioned steering means and throttle means with linkage means therefore to the personal watercraft means. Both single and double bay embodiments are discussed. Like reference numerals are given for like features of single and dual bay embodiments.

In the dual bay embodiment, control cable 120 is routed from steering wheel 40 through sheath 900 to turning linkage 146, which is preferably mounted on or near the floor of cargo area 60. Control cable 120 contains a throttle cable 176 and also contains a stiff member 200 which enables both a pulling and a pushing force to be exerted. Stiff member 200 articulates or turns linkage 146 so as to move starboard stiff member 800 and port cable 802 to push or pull on handlebar 120 via grips 114, 116 of both PWC 100. This, in turn, changes the direction of the force exerted on multi-use watercraft 10, 110 by output port or jet propulsion port 122 of PWC 100. The change in direction of the force serves to turn multi-use watercraft 110, 10 just as it would turn PWC 100. Spring 148 helps to ease the turning of steering wheel 40 by easing the pulling or pushing of cable 120.

Figure 6:
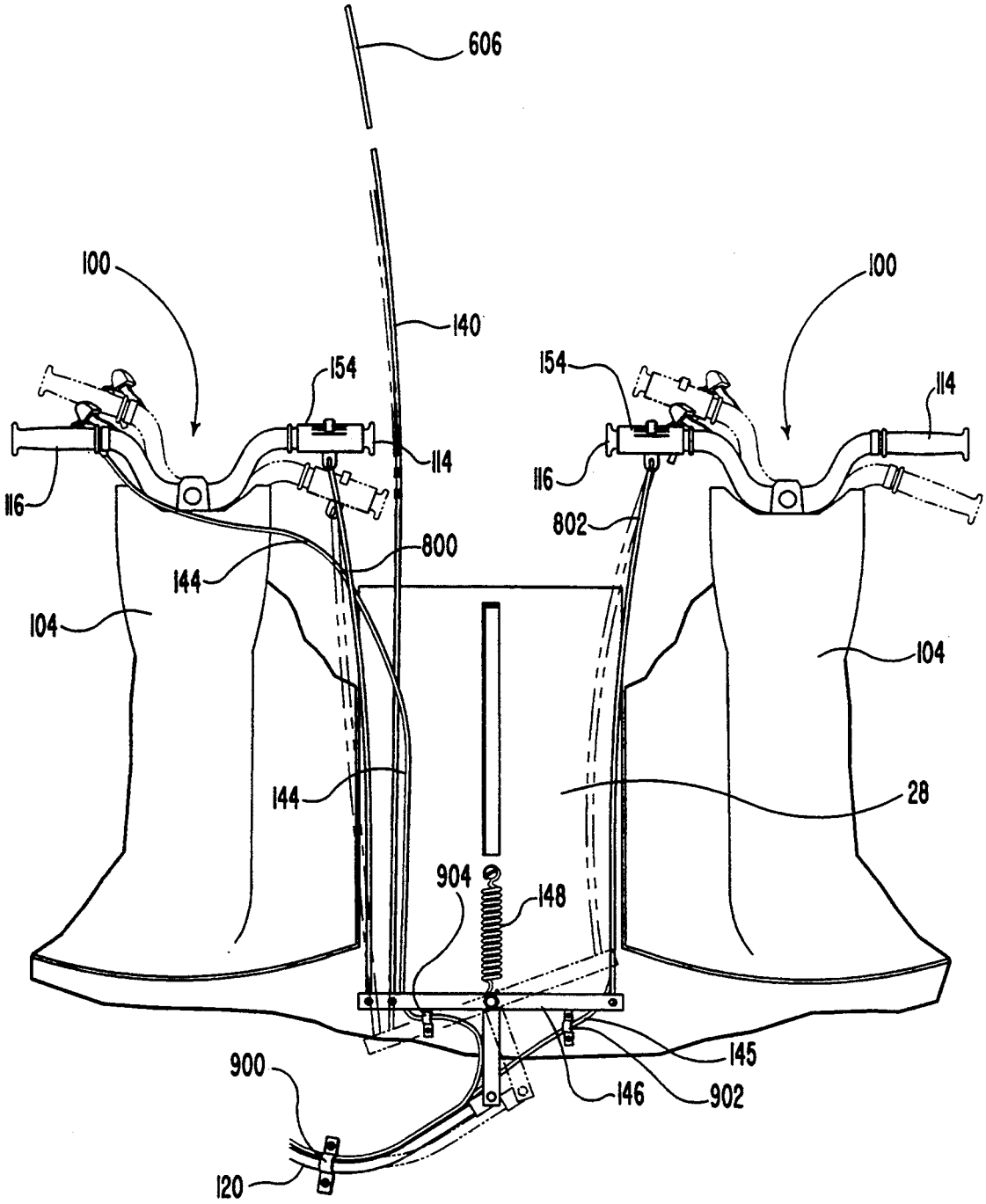
FIG. 6 is a top plan view, as seen from the bow to the stern, illustrating the throttle and steering control cabling which would be utilized in a dual bay multi-use watercraft.

In the dual bay embodiment, and as is more particularly illustrated in FIG. 6, turning linkage 146 connects the port thumb throttle on grip 154 via cable 802 which is co-axial with the stiff member also in port cable 802. Turning linkage 146 connects the starboard thumb throttle on grip 154 via starboard throttle cable 144, which is not coaxial with stiff member 800. Sheath 902 serves to route port cable 145 and sheath 904 serves to route starboard throttle cable 144. A rudder cable 140 has an end 606 which is connected to a perpendicular member extending from stern rudder 950 in FIG. 1, so as to enable steering wheel 40 to turn rudder 950 via rudder cable 140 and turning linkage 146 while underway in the sailing mode, to be described hereinafter. Rudder cable 140 can be so connected when rudder steering is desired. When rudder steering is not being used, rudder cable 140 may be tucked aside or disconnected.

In the single bay embodiment depicted in FIGS. 2, 4, and 7, control cable 120 is routed from steering wheel 40 through sheath 900 for turning handlebars 102 at starboard grip 116. Control cable 120 contains a throttle cable 176, operatively connected so as to control thumb throttle 118, and also contains stiff member 200 which enables both a pulling and a pushing force to be exerted on handlebars 102 which, in turn, changes the direction of the force exerted on multi-use watercraft 110 by the output port or jet propulsion port 122 of PWC 100. The change in direction of the force of the output water stream serves to turn multi-use watercraft 110 just as it would turn PWC 100. Spring 148 helps to ease the turning of steering wheel 40 by easing of the pulling or pushing of cable 120.

In the single bay embodiment, and as is more particularly illustrated in FIG. 2, control cable 120 extends to form a rudder cable 140 when rudder steering is desired. When rudder steering is not being used rudder cable 140 may be tucked aside or disconnected. Rudder cable 140 can be connected to a perpendicular member extending from the starboard rudder board 82. A rigid cross-member 600 connects the port and starboard rudders, 82, 82, which enables movement of them both when the perpendicular extension on the starboardrudder 82 is moved by control cable 120 through sheath 900 via steering wheel 40.

FIGS. 6 and 7 show additional details of the connection of the throttle cabling and steering linkages in the single and dual bay embodiments. A gripping connector 154 is shown attaching to the grip 116 of handlebars 102 to control steering. Gripping connector 154 has an upper half 156 and a lower half 158 which pivot around a center hinge 160. This allows the gripping connector to be opened to receive the grip 116 of handlebars 102 and then clamped down onto grip 116 of the handlebars 102. Grip 116 is then shut and locked in place with clamp 162. Gripping connector 154 also includes a threaded connection 164 to which the eye of the steering rod 166 is connected with screw 168. It will be appreciated that a wide range of methods to connect to a grip of a handlebar could be utilized, including Velcro or other conventional clamp types.

The connection to the thumb throttle 118 is depicted as a square connector 170 attached to a threaded eye 172. Square connector 170 fits over thumb throttle 118 and allow is to be pushed and released. Threaded eye 172 is connected to hook 174 to which the throttle cable 176 is connected. Again, it will be appreciated that alternate methods of connecting the throttle cable 176 to the thumb throttle 118 are possible. Throttle cables 144, 176, and 802 are used in the dual bay embodiment and throttle cable 176 is used in the single bay embodiment.

A roll-throttle handle, as is conventionally used on motorcycle handle bars, may also be accommodated by slight modification to the illustrated handlebar grip 118 and the means for attachment of same to the aforementioned throttle cables.

Control cable 120 is directly or indirectly connected to thumb throttles 118 and also to throttle levers 42, 44. When so linked, throttle levers 42, 44 in the dual bay embodiment 10 and throttle lever 91 in the single bay embodiment 110, control power output by the jet pump output flow rate by controlling the power of PWC 100 via jet pump 502. The dual bay embodiment 10 allows independent throttle control of the two PWC via dual levers 42, 44.

The aforementioned cables 120, 166, 144, 800, 802, 140 may also contain electrical harnesses (not shown) which are connected to electrical wiring of PWC 100 to control a start and a stop function in the ignition system of the PWC 100. If electrical harnessing is included, this cabling should be contained in a watertight jacket.

The power and ignition of PWC 100 are preferably separately controlled. A start button 46 and a stop button 48 as illustrated in FIG. 1, control PWC 100. Preferably, via the aforementioned electric wire harness, start button 46 is connected to the electrical start mechanism of PWC 100 and stop button 48 is connected to the electrical stop of PWC 100. Conventional electrical connections and the aforementioned cabling may be used. Preferably, all connections and cabling may be made watertight. Alternatively, separate start and stop button may be provided for each of the two PWC 100 in dual embodiment 10.

Main seating area 50 of multi-use watercraft 10 is shown as having two seats in cargo area 60. It will be appreciated that multi-use watercraft 10 could be designed to allow for more seating in main seating area 50. While the bow seating 52 is depicted in FIG. 1, it will be appreciated that bow seating is not a necessary feature of the present invention.

The water going vessel may optionally have a sailing rig means for propulsion of the boat means via wind power. The sailing rig means includes a sail means for receiving wind power from wind. By way of illustration and example, the sail means is seen in FIG. 3 at 106 as a main sail and at 108 as a jib sail.

The sailing rig means also includes a mast means, mounted on the topside of the boat means, for hoisting and supporting the sail means, a rudder means, situated at the stern of the boat means, for steering the boat means, and a dagger board means, located in between the bow and stern of the boat means and in between the starboard and port of the boat means, for opposing transverse drift motion of the boat means. Examples illustrative of the mast means, the rudder means, and the dagger board means are respectively mast 68, rudders 82, and dagger board 92.

Aspects of the sailing configuration of the present invention are illustrated in FIGS. 2 and 3 which are applicable to both single and dual bay embodiments 110, 10. Receivers 62 and 64 for connectably mounting the mast 64 are shown. Slot 56 for receivably mounting the center or dagger board 92 is also depicted. Brackets 58 for connectably mounting the rudders 82 are also illustrated.

For the purpose of simplicity and to avoid duplication, additional details of the present invention are shown in FIGS. 2 through 5, with regard to a single bay multi-use watercraft which figures have like reference numbers for like features of FIG. 1.

FIG. 2 illustrates additional details of the sailing mode of the single bay embodiment of the multi-use watercraft 110. Port mast receiver 62 and starboard mast receiver 64 are located on the foreword portion 66 of single bay multi-use watercraft 110. Mast 68 includes a port post 70 and starboard post 72 which are receivably mounted in the respective mast receivers 62, 64. It will be appreciated that numerous other methods of connecting the mast either single or dual bay to multi-use watercraft are possible. Preferably any connecting means used should be quick and easy to use thus allowing the mast to be put up and taken down while on the water. Further, it is preferable that the mast be made of a lightweight while sturdy material. The mast may be stabilized by the addition of cables (not shown) running from the mast to forward 74, port (not shown), starboard (not shown), and aft 80 connectors.

Rudders 82 are also illustrated. The top portions 84 of rudders 82 include connectors 86 which are receivably mounted to rudder brackets 58 so as to articulate circularly as hinges therein. Connectors 86 are shown in an L-shape. However, it will be appreciated that other connectors are possible. The bottom portions 88 of rudders 82 pivot respectively around pivot points 90 such that the angle between top portion 84 and bottom portion 88 may be adjusted if desired. The top portions 84 of rudders 82 are then joined together by a rigid bar 600 so that they can be steered together. When desired, steering can be transferred to the rudders 82, 950 by connections and linkages, as described above, so as to enable steering via steering wheel 40.

Dagger board 92 in FIG. 2 is shown as having a top portion 98 and bottom portion 96. The top portion 94 of dagger board 92 has a lip 98 so that top portion 94 is slightly larger than bottom portion 96. This allows dagger board 92 to slip into and be held in place in dagger board slot 56. Dagger board slot 56 is designed to receivably accept dagger board 92 allowing bottom portion 96 to extend into the water while top portion 94 is held securely in place. Bottom portion 96 of dagger board 92 slips in and through slot 56 easily but lip 98 catches and holds dagger board 92 in place in slot 56. Slot 56, which receivably accepts dagger board 92, may be placed somewhat forward or aft of the depicted location to achieve the desired handling attributes of the multi-use watercraft 10 or 110. The length and surface area of dagger board 92 which should extend into the water will be dependent on the size and hydrodynamics of the multi-use watercraft 10, 110 as well as the size of the sails 106, 108 to be used. It will be appreciated that a number of dagger board designs are possible depending on the characteristics of the vessel and its propensity for transverse drift. Preferably the dagger board will be made of a relatively light weight but extremely durable material. Additionally, the dagger board should be made of a material which is suited to underwater applications.

Additional details of the sailing mode of the multi-use watercraft are also shown in FIG. 3, which is a side elevation of the single bay multi-use watercraft with PWC 100 docked in the bay. Mast 68 is shown in a mounted configuration with forward stabilizing connection 74 and aft stabilizing connection 80 also being depicted. A main sail 106 and jib 108 are shown hoisted on mast 68.

The boat means may optionally include a means, in electrical communication with the power plant of each of the two personal watercraft means, for immediately stopping the running thereof. This stopping means is in electrical communication with a user interface kill switch means situated in the topside cargo area of the boat means and is for initiating the stopping of the power plant means via the user interface kill switch means.

By way of illustration of the stopping means and the user interface kill switch means, FIG. 1 shows stop button 48 for killing the engine in the two PWC 100, preferably via the aforementioned electric wire harnesses. It is preferable that start button 46 will be bifurcated to have a separate switch for each of the two electrical start mechanisms of the two PWC 100, whereas there may be a common stop button 48 for both of the electrical stops of the two PWC 100.

PWC typically have a safety feature designed to keep the PWC from getting away from the riders, which either shuts off the engine of the PWC or causes the PWC to move circularly, in the event that the riders fall off the PWC.

In the case of PWC which utilize a feature to stop the engine, typically a bracelet is attached to the wrist of the riders via a lanyard. If the rider falls off, the bracelet pulls the lanyard which sends a stop signal to the ignition of the PWC which then shuts the engine down. This safety feature is not particularly needed when the PWC is being used to propel the vessel of the present invention. However, it may be desirable to place a bracelet attachment device either on the PWC itself or on the multi-use watercraft which is connected via the lanyard to the stop switch, which illustrates one type of the user interface kill switch means. Such an attachment device could be as simple as an eye through which the bracelet could be threaded and attached.

The boat means may optionally have an on-board power source means, situated in the topside cargo area of the boat means, for supplying power to regulatory and safety lighting situated on the boat means. By way of example and illustration, an on-board power source means is represented by a battery 960 for powering outside light 970.

If the PWC being utilized for propulsion has a mechanism to cause the PWC to circle in the event the rider falls off, this typically will consist of a mechanism which urges the steering either fully to the port side or fully to the starboard side if the driver lets go of the steering. This type of safety feature, typically effected by spring force, forces the steering of the multi-use watercraft to turn to the port or starboard side if the steering wheel is released. By way of example and not by way of limitation, a spring such as spring 148 in FIG. 6 could be modified for such purpose.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. In a boat intended to float in a water medium while coupled and powered by a personal watercraft, the personal watercraft having a bow, a stern, a starboard, and a port, the bow of the personal watercraft having a hull configuration thereat, the bow and stern of the personal watercraft having a keel configuration therebetween, the keel configuration of the personal watercraft having an intake port for taking in a stream of water of the water medium and also having an output port aft of the intake port for outputting the stream of water, the personal watercraft further having a jet pump for pumping the stream of water from the intake port to the output port so as to impel the personal watercraft while floating in the water medium, and having a power plant for driving the jet pump, the personal watercraft also having a steering mechanism for controlling the angle of the output port with respect to both the port and starboard of the personal watercraft so as to control the impelled direction of the personal watercraft, the personal watercraft further having a jet pump throttle mechanism for controlling the jet pump to vary the flow rate of the water stream exiting the output port so as to control the rate of propulsion of the personal watercraft in the water medium, said boat comprising:

a bow, a stern, a starboard, a topside comprising a cargo area and a port, said stern of said boat comprising:

docking means for slidably receiving and at least in part circumscribing a portion of the hull configuration of the personal watercraft, said docking means comprising:

a forward portion;

releasable attachment means for holding the hull configuration of the personal watercraft within said docking means;

means for maintaining the intake port of the personal watercraft within the water medium while the boat is underway comprising:

a plate having a longitudinal length and a trailing edge which extends in width from one side to the other of said docking means, said plate when the hull configuration of the personal watercraft is received within the docking means such that the bow of the personal watercraft is in contact with the forward portion of the docking means, is in contact with and supports a portion of the keel configuration of the personal watercraft and the width of said trailing edge is located forward of said intake port of the personal watercraft;

said boat further comprising:

steering means for a user to control the impelled direction of the boat in the water medium, comprising:

a user steering interface situated in the cargo area; and a steering linkage means, connected to the steering mechanism of the personal watercraft and also connected to the user steering interface, for moving the steering mechanism of the personal watercraft so as to control the angle of the output port;

throttle means for a user to control the jet pump, comprising:

a user throttle interface located in the cargo area; and a throttle linkage means, connected to the jet pump throttle mechanism and also connected to the user throttle interface, for moving the jet pump throttle mechanism via the user throttle interface.

2. The boat as defined in claim 1, wherein the docking means further comprises:

a recessed area in the stern of the boat, and an adapter means, situated on an external surface of the recessed area, for cushioning and making an interface of conforming fit between the hull configuration of the personal watercraft and the recessed area.

3. The boat as defined in claim 1, further comprising plurality of said docking means each receiving a separate one of said personal watercraft, the steering linkage means also being connected to the steering mechanism of each of said personal watercraft, the throttle linkage means also being connected to the jet pump throttle mechanism of each of said personal watercraft, whereby the user controls the direction and the propulsion of the boat respectively by the user steering interface and the user throttle interface.

4. The boat as defined in claim 3 further comprising:

sailing rig means for propulsion of the boat via wind power comprising:

sail means for receiving wind power from wind;

mast means, mounted on the topside of the boat, for hoisting and supporting said sail means;

rudder means, situated at the stern of the boat, for steering the boat;

dagger board means, located in between the bow and stern of the boat and in between the starboard and port of the boat, for opposing transverse drift motion of the boat.

5. The boat as defined in claim 3, further comprising means, in electrical communication with the power plant of each of said plurality of personal watercraft, for immediately stopping the running thereof, said stopping means being in electrical communication with a user interface kill switch means situated in the cargo area of said boat, for initiating the stopping of said power plants via said stopping means.

6. The boat as defined in claims 1, further comprising:

sailing rig means for propulsion of the boat via wind power comprising:

sail means for receiving wind power from wind;

mast means, mounted on the topside of the boat, for hoisting and supporting said sail means;

rudder means, situated at the stern of the boat, for steering the boat;

dagger board means, located in between the bow and stern of the boat and in between the starboard and port of the boat, for opposing transverse drift motion of the boat.

7. The boat as defined in claim 1, further comprising on-board power source means, situated in the cargo area of the boat, for supplying power to regulatory and safety lighting situated on the boat.

8. The boat as defined in claim 1, wherein the bow of said boat comprises a port hull, a starboard hull, and a keel hull located therebetween.

9. A water going vessel intended to float and be propelled in a water medium comprising:

personal watercraft means for powering said water going vessel comprising:

a bow, a stern, a starboard, and a port, said bow having a hull configuration thereat, the bow and the stern having a keel configuration therebetween, the keel configuration having a means for intaking a stream of water and having a means, aft of said water intaking means, for outputting said stream of water;

jet pump means for pumping said stream of water from said intake means to said output means so as to impel the personal watercraft means while floating in the water medium;

power plant means for driving the jet pump means;

handlebar means for controlling the angle of the outputting means with respect to both the port and starboard of said personal watercraft means so as to control the impelled direction of the personal watercraft means; and means for controlling the jet pump means so as to vary the flow rate of said water stream exiting the outputting means and to control the propulsion rate of the personal watercraft means in the water medium, boat means, powered by said personal watercraft means, for carrying cargo comprising:

a bow, a stern, a starboard, a topside comprising a cargo area and a port, said stern of said boat means comprising:

docking means for slidably receiving and at least in part circumscribing a portion of the hull configuration of the personal watercraft means, said docking means comprising:

releasable attachment means for holding the hull configuration of the personal watercraft means within said docking means;

means for maintaining the intake means of the personal watercraft means in the water medium while the water going vessel is underway;

steering means for a user to control the impelled direction of the boat means in the water medium, comprising:

a user steering interface; and a steering linkage means, connected to the handlebar means of the personal watercraft means and also connected to the user steering interface, for moving the handlebar means so as to control the angle of the outputting means;

throttle means for a user to control the jet pump means, comprising:

a user throttle interface; and a throttle linkage means, connected to the means for controlling the jet pump means and also connected to the user throttle interface, for moving the means for controlling jet pump means via the user throttle interface.

10. The water going vessel as defined in claim 9, wherein the docking means further comprises:

a recessed area in the stern of the boat means, and an adapter means, situated on an external surface of the recessed area, for cushioning, and making an interface of conforming fit between the hull configuration of the personal watercraft means and the recessed area.

11. The water going vessel as defined in claim 9, further comprising a plurality of said docking means and a corresponding plurality of personal watercraft means, each said docking means receiving a separate one of said personal watercraft means, the steering linkage means also being connected to the steering mechanism of each said personal watercraft means, the throttle linkage means also being connected to the jet pump throttle mechanism of each said personal watercraft means, whereby the user controls the direction and the propulsion of the water going vessel in the water medium respectively by the user steering interface and the user throttle interface.

12. The water going vessel as defined in claims 11, further comprising:

sailing rig means for propulsion of the water going vessel via wind power comprising:

sail means for receiving wind power from wind;

mast means, mounted on the topside of the boat means, for hoisting and supporting said sail means;

rudder means, situated at the stern of the boat means, for steering the boat means;

dagger board means, located in between the bow and stern of the boat means and in between the starboard and port of the boat means, for opposing transverse drift motion of the boat means in the water medium.

13. The water going vessel as defined in claim 9, further comprising:

sailing rig means for propulsion of the water going vessel via wind power comprising:

sail means for receiving wind power from wind;

mast means, mounted on the topside of the boat means, for hoisting and supporting said sail means;

rudder means, situated at the stern of the boat means, for steering the boat means;

dagger board means, located in between the bow and stern of the boat means and in between the starboard and port of the boat means, for opposing transverse drift motion of the boat means in the water medium.

14. The water going vessel as defined in claim 9, wherein the power plant means of the personal watercraft means is a two cycle, two stroke water cooled engine.

15. A water going vessel intended to float and be propelled in a water medium comprising:

first and second personal watercraft means for powering said water going vessel, each comprising:

a bow, a stern, a starboard, and a port, said bow having a hull configuration thereat, the bow and the stern having a keel configuration therebetween, the keel configuration having a means for intaking a stream of water and having a means, aft of said water intaking means, for outputting said stream of water;

jet pump means for pumping said stream of water from said intake means to said output means so as to impel the personal watercraft means while floating in the water medium;

power plant means for driving the jet pump means;

handlebar means for controlling the angle of the outputting means with respect to both the port and starboard of said personal watercraft means so as to control the impelled direction of the personal watercraft means; and means for controlling the jet pump means so as to vary the flow rate of said water stream exiting the outputting means and to control the propulsion rate of the personal watercraft means in the water medium;

boat means, powered by said first and second personal watercraft means, for carrying cargo comprising:

a bow, a stern, a starboard, a topside comprising a cargo area and a port, said stern of said boat means comprising:

first and second docking means for slidably receiving and at least in part circumscribing, respectively, a portion of the hull configuration of the first and second personal watercraft means, the first and second docking means respectively comprising:

first and second releasable attachment means for holding the hull configuration of the respective first and second personal watercraft means respectively within the first and second docking means;

first and second means for maintaining the intake means of the respective first and second personal watercraft means in the water medium while the water vessel is underway;

steering means, for a user to control the impelled direction of the boat means in the water medium, comprising:

a user steering interface situated in the cargo area of the boat means; and a steering linkage means, connected to the handlebar means of both the first and second personal watercraft means and also connected to the user steering interface, for simultaneously moving the handlebar means of the first and second personal watercraft means so as to respectively control the angle of the outputting means of the first and second personal watercraft means;

throttle means for a user to control each jet pump means of the first and second personal watercraft means, comprising:

first and second user throttle interface situated in the cargo area of the boat means; and a throttle linkage means, connected to the means for controlling the jet pump means of both the first and second personal watercraft means and also connected to the first and second user throttle interface, for respectively moving the means for controlling the jet pump means of the first and second personal watercraft means via the user throttle interface;

whereby the user controls the direction and the propulsion of the water going vessel in the water medium respectively by the user steering interface and the user throttle interface.

16. The water going vessel as defined in claim 15, wherein the first and second docking means respectively further comprise:

first and second recessed areas in the stern of the boat means, and first and second adapter means, respectively situated on an external surface of the first and second recessed areas, for cushioning, and making an interface of conforming fit respectively between the hull configuration of the first and second personal watercraft means and the first and second recessed areas.

17. The water going vessel as defined in claim 15, further comprising:

sailing rig means for propulsion of the water going vessel via wind power comprising:

sail means for receiving wind power from wind;

mast means, mounted on the topside of the boat means, for hoisting and supporting said sail means;

rudder means, situated at the stern of the boat means, for steering the boat means;

dagger board means, located in between the bow and stern of the boat means and in between the starboard and port of the boat means, for opposing transverse drift motion of the boat means in the water medium.

18. The water going vessel as defined in claim 15, wherein each of the power plant means of the first and second personal watercraft means is a two cycle, two stroke water cooled engine, the two engines having together a combined engines displacement of greater than 1100 ccm.

19. A water going vessel intended to float and be propelled in a water medium comprising:

first and second personal watercraft means for powering said water going vessel, each comprising:

a bow, a stern, a starboard, and a port, said bow having a hull configuration thereat, the bow and the stern having a keel configuration therebetween, the keel configuration having a means for intaking a stream of water and having a means, aft of said water intaking means, for outputting said stream of water;

jet pump means for pumping said stream of water from said intake means to said output means so as to impel the personal watercraft means while floating in the water medium;

power plant means for driving the jet pump means;

handlebar means for controlling the angle of the outputting means with respect to both the port and starboard of said personal watercraft means so as to control the impelled direction of the personal watercraft means; and means for controlling the jet pump means so as to vary the flow rate of said water stream exiting the outputting means and to control the propulsion rate of the personal watercraft means in the water medium;

boat means, powered by said first and second personal watercraft means, for carrying cargo comprising:

a bow, a stern, a starboard, a topside comprising a cargo area and a port, said stern of said boat means comprising:

first and second docking means for slidably receiving and at least in part circumscribing, respectively, a portion of the hull configuration of the first and second personal watercraft means, the first and second docking means respectively comprising:

first and second releasable attachment means for holding the hull configuration of the respective first and second personal watercraft means respectively within the first and second docking means;

first and second means for maintaining the intake means of the respective first and second personal watercraft means in the water medium while the water vessel is underway;

steering means, for a user to control the impelled direction of the boat means in the water medium, comprising:

a user steering interface situated in the cargo area of the boat means; and a steering linkage means, connected to the handlebar means of both the first and second personal watercraft means and also connected to the user steering interface, for simultaneously moving the handlebar means of the first and second personal watercraft means so as to respectively control the angle of the outputting means of the first and second personal watercraft means;

throttle means for a user to control each jet pump means of the first and second personal watercraft means, comprising:

first and second user throttle interface situated in the cargo area of the boat means;

a throttle linkage means, connected to the means for controlling the jet pump means of both the first and second personal watercraft means and also connected to the first and second user throttle interface, for respectively moving the means for controlling the jet pump means of the first and second personal watercraft means via the user throttle interface, whereby the user controls the direction and the propulsion of the water going vessel in the water medium respectively by the user steering interface and the user throttle interface;

sailing rig means for propulsion of the water going vessel via wind power comprising:

sail means for receiving wind power from wind;

mast means, mounted on the topside of the boat means, for hoisting and supporting said sail means;

rudder means, situated at the stern of the boat means, for steering the boat means;

dagger board means, located in between the bow and stern of the boat means and in between the starboard and port of the boat means, for opposing transverse drift motion of the boat means in the water medium.

20. The water going vessel as defined in claim 19, wherein the first and second docking means respectively further comprise:

first and second recessed areas in the stern of the boat means, and first and second adapter means, respectively situated on an external surface of the first and second recessed areas, for cushioning, and making an interface of conforming fit respectively between the hull configuration of the first and second personal watercraft means and the first and second recessed areas.

21. The water going vessel as defined in claim 19, wherein each of the power plant means of the first and second personal watercraft means is a two cycle, two stroke water cooled engine.

* * * * *